United States Patent [19]

Merritt et al.

[11] 4,388,932

[45] Jun. 21, 1983

[54] PROCESS FOR IMPROVING FILLING POWER OF EXPANDED TOBACCO

[75] Inventors: Henry B. Merritt, Richmond; Larry M. Sykes, Midlothian, both of Va.

[73] Assignee: Philip Morris, Incorporated, New York, N.Y.

[21] Appl. No.: 221,910

[22] Filed: Dec. 31, 1980

[51] Int. Cl.[3] ..... A24B 3/18

[52] U.S. Cl. ..... 131/291; 131/290; 131/903

[58] Field of Search ..... 131/903, 291, 293, 294–296

[56] References Cited

U.S. PATENT DOCUMENTS

| | | | |
|---|---|---|---|
| 1,789,435 | 1/1931 | Hawkins | 131/296 |
| 2,596,183 | 5/1952 | Sowa | 131/296 |
| 2,656,841 | 10/1953 | Gurley | 131/296 |
| 3,409,022 | 11/1968 | de la Burde | 131/296 |
| 3,409,023 | 11/1968 | de la Burde | 131/296 |
| 3,409,027 | 11/1968 | de la Burde | 131/296 |
| 3,409,028 | 11/1968 | de la Burde | 131/296 |
| 3,425,425 | 2/1969 | Hind | 131/296 |
| 3,524,451 | 8/1970 | Fredrickson | 131/296 |
| 3,524,452 | 8/1970 | Moser | 131/296 |
| 3,529,606 | 9/1970 | de la Burde | 131/296 |
| 3,690,328 | 9/1972 | Quarenghi | 131/296 |
| 3,710,803 | 1/1973 | Johnson | 131/296 |
| 3,734,104 | 5/1973 | Buchanan et al. | 131/296 |
| 3,753,440 | 8/1973 | Ashburn | 131/296 |
| 3,771,533 | 11/1973 | Armstrong et al. | 131/293 |
| 3,957,063 | 5/1976 | Wochnowski | 131/903 |
| 3,978,867 | 9/1976 | Wochnowski | 131/296 |
| 4,040,431 | 9/1977 | Ashworth et al. | 131/296 |
| 4,044,780 | 8/1977 | Kelly | 131/296 |
| 4,209,537 | 6/1980 | Wood | 131/296 |
| 4,238,249 | 11/1980 | Psaras | 131/296 |
| 4,244,381 | 1/1981 | Lendvay | 131/296 |
| 4,250,898 | 2/1981 | Utsch et al. | 131/291 |
| 4,266,562 | 5/1981 | Merritt | 131/296 |

FOREIGN PATENT DOCUMENTS

| | | | |
|---|---|---|---|
| 977235 | 11/1975 | Canada | 131/296 |
| 980206 | 12/1975 | Canada | 131/296 |
| 675292 | 7/1952 | United Kingdom | 131/291 |
| 1293735 | 10/1972 | United Kingdom | 131/296 |

OTHER PUBLICATIONS

Alien Property Custodian, Ser. No. 304,214, published May 11, 1943.

South African Patent Application 70/8291, 70/8292, 12/70.

"Puffing in Perspective", *Tobacco Reporter*, 11/69.

*Primary Examiner*—V. Millin

*Attorney, Agent, or Firm*—Arthur I. Palmer, Jr.; George E. Inskeep

[57] ABSTRACT

Tobacco which has been increased in filling power by a conventional tobacco expansion process can be further increased in filling power by a post expansion heat treatment. The post expansion heat treatment comprises contacting the expanded tobacco produced by a conventional expansion process with a gaseous medium, such as air and/or steam, at a temperature of from about 200° F. to about 450° F. The post expansion heat treatment is preferably conducted at a lower temperature than the temperature of the heating step of the expansion process, and thus can be more easily controlled, while providing an additional increase in filling power. The product of the post expansion heat treatment process of this invention has been found to be as acceptable in subjective smoking characteristics as the expanded tobacco which is treated by the process.

11 Claims, No Drawings

PROCESS FOR IMPROVING FILLING POWER OF EXPANDED TOBACCO

BACKGROUND OF THE INVENTION

The tobacco art has long recognized the desirability of expanding tobacco to increase the bulk or volume of tobacco. It has been desired to increase the filling power of tobacco so that a smaller amount of tobacco would be required to produce a smoking product, such as a cigarette, which would have the same firmness and yet would produce lower tar and nicotine than the comparable smoking product made of non-expanded tobacco having a more dense tobacco filler.

Various methods have been proposed for expanding tobacco, including the impregnation of tobacco with a gas under pressure and the subsequent release of the pressure, whereby the gas causes expansion of the tobacco cells to increase the volume of the treated tobacco. Other methods which have been employed or suggested have included the treatment of tobacco with various liquids, such as water or relatively volatile organic liquids, to impregnate the tobacco with the same, after which the liquids are driven off to expand the tobacco. Additional methods which have been suggested have included the treatment of tobacco with solid materials which, when heated, decompose to produce gases which serve to expand the tobacco. Other methods include the treatment of tobacco with gas-containing liquids, such as carbon dioxide-containing water, under pressure to incorporate the gas in the tobacco and then the tobacco impregnated therewith is heated or the pressure thereon is reduced to thereby expand the tobacco. Additional techniques have been developed for expanding tobacco which involve the treatment of tobacco with gases which react to form solid chemical reaction products within the tobacco, which solid reaction products may then be decomposed by heat to produce gases within the tobacco which cause expansion of the tobacco upon their release. More specifically:

A patent to Wilford J. Hawkins, U.S. Pat. No. 1,789,435, granted in 1931, describes a method and apparatus for expanding the volume of tobacco. To accomplish this object, the cured and conditioned tobacco is contacted with a gas, which may be air, carbon dioxide or steam under pressure and the pressure is then relieved, whereby the tobacco tends to expand. The patent states that the volume of the tobacco may, by that process, be increased to the extent of about 5–15%.

An alien property custodian document No. 304,214 to Joachim Bohme, dated 1943, indicates that tobacco can be expanded using a high frequency generator but that there are limitations to the degree of expansion which can be achieved without affecting the quality of the tobacco.

A patent to Frank J. Sowa, U.S. Pat. No. 2,596,183, granted in 1952, sets forth a method for increasing the volume of shredded tobacco by adding additional water to the tobacco to cause the tobacco to swell and thereafter heating the moisture containing tobacco, whereby the moisture evaporates and the resulting moisture vapor causes expansion of the tobacco.

A series of patents to Roger Z. de la Burde, granted in 1968, specifically U.S. Pat. Nos. 3,409,022, 3,409,023, 3,409,027 and 3,409,028, relate to various processes for enhancing the utility of tobacco stems for use in smoking products by subjecting the stems to expansion operations utilizing various types of heat treatment or microwave energy.

A patent to John D. Hind, granted in 1969, U.S. Pat. No. 3,425,425, which is assigned to the same assignee as the assignee of the present invention, relates to the use of carbohydrates to improve the puffing of tobacco stems. In that process, tobacco stems are soaked in an aqueous solution of carbohydrates and then heated to puff the stems. The carbohydrate solution may also contain organic acids and/or certain salts which are used to improve the flavor and smoking qualities of the stems.

A publication in the "Tobacco Reporter" of November 1969 by P. S. Meyer describes and summarizes tobacco puffing or expansion procedures or investigations for expanding and manipulating tobacco for purposes of reducing costs and also as the means for reducing the "tar" content by reduction in the delivery of smoke. Mention is made in this publication of puffing tobacco by different procedures including the use of halogenated hydrocarbons, low pressure or vacuum operation, or high pressure steam treatment that causes leaf expansion from inside the cell when outside pressure is suddenly released. Mention is also made in this publication of freeze-drying tobacco which can also be employed to obtain an increase in volume.

Since the above-mentioned "Tobacco Reporter" article was published, a number of tobacco expansion techniques, including some of the techniques described in the article, have been described in patents and/or published patent applications. For example:

U.S. Pat. No. 3,524,452 to Glenn P. Moser et al and U.S. Pat. No. 3,524,451 to James D. Frederickson, both issued in 1970, relate to the expansion of tobacco using a volatile organic liquid, such as a halogenated hydrocarbon.

U.S. Pat. No. 3,734,104 to William M. Buchanan et al, which is assigned to the same assignee as the assignee of the present invention, issued in 1973 and relates to a particular process for the expansion of tobacco stems.

U.S. Pat. No. 3,710,803 to William H. Johnson, issued in 1973 and British Specification No. 1,293,735 to American Brands Inc., published in 1972, both relate to freeze drying methods for expanding tobacco.

South African applications Nos. 70/8291 and 70/8292 to R. J. Reynolds Tobacco Company, both issued in 1970, relate to tobacco expansion employing chemical compounds which decompose to form a gas or with inert solutions of a gas under pressure to maintain the gas in solution until it impregnates the tobacco.

A patent to Robert G. Armstrong et al, U.S. Pat. No. 3,771,533, issued in 1973, which is assigned to the same assignee as the assignee of the present invention, involves a treatment of tobacco with carbon dioxide and ammonia gases, whereby the tobacco is contacted with these gases and ammonium carbonate is formed in situ. The ammonium carbonate is thereafter decomposed by heat to release the gases within the tobacco cells and to cause expansion of the tobacco.

Despite all of the above-described advances in the art, no completely satisfactory process has been found. The difficulty with the various earlier suggestions for expanding tobacco is that, in many cases, the volume is only slightly or at best only moderately increased. Freeze drying has the disadvantages of requiring elaborate and expensive equipment and very substantial operating costs. With respect to the teaching of using heat energy, infrared energy or radiant microwave energy to expand tobacco stems, the difficulty is that while stems respond to these heating procedures, tobacco leaf has not generally been found to respond effectively to this type of process.

The use of special expanding agents, for example, halogenated hydrocarbons, such as are mentioned in the Meyer publication for expanding tobacco, is also not completely satisfactory because these substances are generally required to volatilize to remove the substances after the tobacco has been expanded. The introduction, in considerable concentration, of materials which are foreign to tobacco presents the problem of removing the expansion agent after the treatment has been completed in order to avoid affecting aroma and other properties of the smoke due to extraneous substances used or developed from the combustion of the treated tobacco.

The use of solid chemicals to produce a gas upon decomposition has not been found satisfactory, perhaps due to the fact that the chemicals cannot be incorporated in the cells of the tobacco.

The use of carbonated water has also not been found to be effective.

While the method employing ammonia and carbon dioxide gases is an improvement over the earlier described methods, it is not completely satisfactory and can result, under some circumstances, in undesired deposition of ammonium carbonate during the process.

A process employing liquid carbon dioxide has been found to overcome many of the disadvantages of the abovementioned prior art processes. The expansion of tobacco, using liquid carbon dioxide is described in Belgium Pat. No. 821,568, which corresponds to U.S. patent application Ser. No. 441,767 to de la Burde et al and assigned to the same assignee as the present application and in Belgium Pat. No. 825,133 to Airco, Inc. This process may be described as a process for expanding tobacco comprising the steps of (1) contacting the tobacco with liquid carbon dioxide to impregnate the tobacco with the liquid carbon dioxide, (2) subjecting the liquid carbon dioxide-impregnated tobacco to conditions such that the liquid carbon dioxide is converted to solid carbon dioxide and (3) thereafter subjecting the solid carbon dioxide-containing tobacco to conditions whereby the solid carbon dioxide is vaporized to cause expansion of the tobacco.

Further improvements in the carbon dioxide process described above (which may be referred to as the DIET process) have been described and claimed in copending application Ser. No. 822,793, filed Aug. 8, 1977 in the name of one of the present coinventors, Larry M. Sykes, together with another coinventor, Ray G. Snow. In that application, a process is described for obtaining superior results at lower pressures than would otherwise be employable, by controlling the input moisture to a higher than normal level, i.e., to from about 17 to about 30 percent with respect to the tobacco fed to the first step of the process and by controlling the output moisture from the last step of the process to be no higher than about 6 percent, and preferably less than about 3 percent.

The present invention involves a process which can be employed for the additional treatment of tobacco materials which have been increased in filling power by processes of the type described above, and particularly the process which involves the use of carbon dioxide in liquid form, to provide further increases in filling power over that achieved by such processes.

SUMMARY OF THE INVENTION

Expanded tobacco from a known expansion process which employs rapid-heating as a step in the process, for example, an expansion process such as that described in copending applications Ser. No. 441,767, filed Feb. 12, 1974 or Ser. No. 822,793, filed Aug. 8, 1977, which employs liquid $CO_2$ as the impregnant is, which at a relatively low moisture content, subjected to a heating step to provide a product which, upon reordering has a greater filling power than the expanded tobacco would have had, without such a heating step. The heating step is preferably conducted under milder conditions than the heating step in the expansion process and preferably is conducted for a period of from about one half minute to as long as a number of days, in a gaseous atmosphere, such as air or superheated steam, most preferably the latter. The product may then be brought to ambient conditions and may then be reordered to a desired moisture level under conventional conditions for use in a smoking product or the like.

DETAILED DESCRIPTION OF THE INVENTION

Filler-cut tobacco that has been expanded by an expansion process employing, as a final expansion step, the step of rapid heating, usually following impregnation with an expanding agent, is, in accordance with the present invention, further heat-treated by exposure to a hot gas. The present heat treatment, which may be called post expansion heat treatment (PEHT), is preferably conducted for a longer time and at a temperature oridinarily lower than was employed in the initial rapid heat/expansion step. The result of this post treatment is an expanded tobacco product which, after reordering to moisture conditions of normal use, has a filling power which is increased substantially over that which it would have had without the post treatment.

The gas employed in the present process may be steam, air or the like, for example, an inert gas such as nitrogen or carbon dioxide. When the gas employed is air or a similar gas, the temperature is preferably from about 200° F. to about 450° F. When steam is employed, the temperature is preferably from about 221° F. to about 450° F. and most preferably from about 230° F. to about 400° F. Air-steam mixtures may also be employed advantageously. The time of exposure is preferably from about 0.5 minute to several days, and most preferably from about 5 to 20 minutes, depending on the temperature used.

The post expansion heat treatment may be carried out by known procedures for heat treating particulate matter.

While we believe our invention is most favorably carried out under the conditions set forth above and is particularly favorably conducted under the conditions set forth with respect to the parameters of times of heating and temperatures of heating, it is our belief, based on early observations, that the effect of post expansion heat treatment can be achieved even at room temperature, for example, at 75° F., provided that the post expansion heat treatment at room temperature is conducted for a sufficiently long period of time. Such a period of time could actually amount to a number of months, in order to effectuate an increased in effective filling power of the expanded tobacco. We also believe that temperatures higher than those set forth in this specification could be employed for a post expansion heat treatment, provided that the time interval involved for such treatment is sufficiently short to prevent burning or damage to the tobacco.

The present invention has been found to be effective in connection with the DIET process, as defined in this specification, and has been found effective when employed in connection with a cyclone separator employed at the output end of the heating tower in such a process.

The post expansion heat treatment may be carried out in many ways, including the fixed bed process defined in detail in this application, fluidized bed processes as have been described in the art, continuous processes involving moving beds and the like and, as indicated above, contact of the expanded tobacco with a warm gas under flow conditions or under static conditions for sufficiently long periods of time to effectuate the additional increase in filling power achieved by practicing the present invention.

In the present process, steam has been found to give somewhat more rapid response than air at the same temperature and causes less darkening of the tobacco at the higher temperatures. For that reason, it is in most instances the preferred gaseous agent for the present process. The simplicity and low cost of handling and recycling air may be a consideration.

To carry out the process of the present invention, one may employ expanded tobacco from a conventional process where the tobacco has been heated as one step of the process. For example, in the DIET process, a convenient means of expanding the solid carbon dioxide-containing tobacco is to place it or to entrain it in a stream of heated gas, such as superheated steam or to place it in a turbulent air stream maintained, for example, at a temperature as low as about 212° F. and as high as about 698° F. and preferably at a temperature of from about 300° to about 500° F. for a period of about 0.2 to 10 seconds. The impregnated tobacco may also be heated by being placed on a moving belt and exposed to infrared heating, by exposure in a cyclone separator, by contact in a dispersion dryer with superheated steam or a mixture of steam and air or the like. The tobacco in such expansion processes will generally be in chopped or shredded form and will have a particle size of about 20 to 100 mesh or larger but is preferably not less than about 30 mesh in size. The expanded tobacco should be in relatively dry form and preferably has a relatively low OV content which is, most preferably, no higher than about 6 percent. As used herein, OV means the weight loss (oven volatiles) measured after exposure of a weighed tobacco sample to a temperature of 212° F. for three hours in a circulating air oven. It is approximately equivalent to moisture content, since no more than about 0.9 percent by weight of tobacco is volatiles other than water. The term "input moisture" or "input OV" herein will refer to input to the post-expansion treatment unless otherwise stated.

The tobacco, at the desired low moisture level, and without any reordering, is then subjected to the post expansion heating step of the present process. The post expansion heating step which may comprise contacting the tobacco with an inert gas, such as nitrogen or carbon dioxide or with air and preferably comprises steam or a mixture of steam in air, is preferably conducted at from about 200° F. to about 450° F. for a period of from as little as about 0.1 minute to several days, depending upon the temperature employed. A very desirable aspect of this heating step is its employment at a temperature somewhat lower than that employed in the heating step of the expansion process, which therefore involves a heating step at a somewhat longer period of time than that employed in the comparable expansion process. While this is essentially a preferred mode of operation, the use of this more controlled secondary heating step provides additional filling power to the tobacco, without any detrimental effects being caused due to the additional heating.

As one of the present coinventors recognized in the above-mentioned application Ser. No. 822,793, it was important in connection with that particular embodiment of the overall carbon dioxide process that the exit OV of the heated tobacco from the expansion step be no more than 6 percent. It was therein stated that the result of this relatively dry condition was an optimum permanent expansion, after reordering to standard moisture conditions. It was also stated that such exit OV from the expansion could be achieved by the proper balance between feed rate of the impregnated tobacco to the dryer and temperature of dryer gas or could also be accomplished by bringing the exit OV of the product down to a desired level by further treatment of the product, as in a dryer. In accordance with the present invention, the exit OV from the post-expansion treatment is well below the 6 percent mentioned in that application and, indeed, well below the 3 percent which is set forth as a goal in that application. It will be seen from that application that exit OV's as low as 1.8 and 1.3 were obtained in some runs. In accordance with the present invention, the input OV of the expanded tobacco employed as feed in the present process may be of the order of 6 percent or 3 percent or even lower. The tobacco should, after treatment in accordance with the present post expansion heating process, have an output OV which is somewhat less than 2 percent, is preferably less than 1 percent, and may be as low as 0 percent, that is, not measurable by the conventional method.

While it is possible that moisture contents quite different from those described above may be employed, it is believed that those parameters as set forth above represent the most effective parameters in accordance with the present invention.

While it is believed possible that the present invention can provide increased filling power when employed with the product of various known expansion techniques, for example, the ammonia gas-carbon dioxide gas technique of Armstrong, the use of ammonium carbonate as an expanding agent, the use of ammonium bicarbonate as an expanding agent, the use of ammonium carbamate as an expanding agent, the use of high pressure $CO_2$, the use of organic materials such as Freon as expanding agents and the like, the process has been proven effective when employed with expanded tobacco from the process employing liquid carbon dioxide as the impregnant, which process includes converting the liquid carbon dioxide to solid carbon dioxide and thereafter expanding the tobacco by heating the solid carbon dioxide containing tobacco to cause the solid carbon dioxide to vaporize (the DIET process). The present process is also effective when employed with expanded tobacco produced by the expansion process which employs $NH_3$—$CO_2$ gases (referred to as the ET process).

The post-expansion heat treatment (PEHT) of tobacco which has been expanded with liquid carbon dioxide (DIET) or with $NH_3$—$CO_2$ gases (ET) has been shown to add major increases to product cylinder volume. Increases on the order of 20–30 CV units (as described later in this specification) appear practical for large-scale processing. There is an accompanying decrease in the equilibrated moisture level, but the moisture reduction is not responsible for the total CV increase. Chemical changes such as reductions in alkaloids, total reducing sugars, propylene glycol and glycerine depend on the severity and duration of treatment. Increases in reordered specific volume have also been noted following treatment. Specific volume (SV) is measured by displacement of acetone and is thus not a bulk property but is a property of individual shreds including any internal voids. Weight losses depend on the severity and time of treatment but typically have been found to be less than 7%. Chemical analysis of the product did not show changes in the non-volatile minerals so that some of the loss can probably be attributed to the loss of fines during treatment.

The post-expansion heat treatment can be accomplished using either steam or air as the treatment gas, although steam appears to be more efficient. The increase in CV improves both with increasing treatment temperature and time. Similar product characteristics can be obtained by treating at low temperatures for long times or at high temperatures for shorter times.

Promising subjective results and filling power advantages were found using a static bed. High temperature-short time treatment of DIET has indicated the feasibility of continuous PEHT.

While we do not wish to be bound by any particular theory, we believe that the filling power of a tabacco sample is related to the flexural properties (stiffness) of the tobacco shreds. In turn, the overall flexural properties of a shred are related to the modulus of the cell wall material and the shape of the cell wall. This is comparable to the flexural properties of a steel beam which is described by the flexural modulus of the steel and the shape of the beam (a hollow tube is stiffer than a solid rod of the same weight per unit length). In a similar manner in an expanded tobacco the cell walls are straightened and the enclosed volume of the shred is enlarged, so that the shred is stiffened. The degree of stiffening can be related to the degree of expansion as measured by the specific volume (SV) of the shred. It has been shown that tobacco shreds are well expanded (SV 3.5–4.5 cc/g) leaving the expansion unit prior to reordering. Under normal processing, the SV decreases upon reordering to 2.0–3.0. A similar sample heat-treated according to the invention does not collapse so much upon reordering (SV 2.5–3.5). Filling power is thus better maintained.

After the tobacco has been recovered from the heating/expansion step at the desired exit OV, it is then, generally, equilibrated (reordered) at conditions which are well known in the trade. Reordering is preferably done at standard conditions, which generally involve maintaining the tobacco at a temperature of 75° F. and 60% RH (relative humidity) for at least 18 hours.

The terms "cylinder volume" and "corrected cylinder volume" are units for measuring the degree of expansion of tobacco. They are, therefore, a measure of the relative filling power of tobacco for making smoking products. The term "oven volatiles" describes a measure of the approximate moisture content (or percentage of moisture) in tobacco. As used throughout this application, the values employed, in connection with these terms, are determined as follows:

Cylinder Volume (CV)

Tobacco filler weighing 10.000 g is placed in a 3.358-cm diameter cylinder and compressed by a 1875-g piston 3.335-cm in diameter for five minutes. The resulting volume of filler is reported as cylinder volume. This test is carried out at standard environmental conditions of 75° F. and 60% RH; conventionally unless otherwise stated, the sample is preconditioned in this environment for 18 hours.

Corrected Cylinder Volume (CCV)

The CV value may be adjusted to some specified oven-volatile content in order to facilitate comparisons.

$CCV = CV + F\ (OV - OV_s)$ where $OV_s$ is the specified OV and F is a correction factor (volume per %) predetermined for the particular type of tobacco filler being dealt with.

For expanded bright tobacco employed in the present application, the value of F in the calculation of CCV is 7.4.

Oven-Volatiles Content (OV)

The sample of tobacco filler is weighed before and after exposure for 3 hours in a circulating air oven controlled at 100° C. (212° F.). The weight loss as a percentage of the initial weight is the oven-volatiles content.

The following examples are illustrative:

EXAMPLE 1

One-pound samples of tobacco (commercial blend, filler-cut) that had been impregnated with liquid carbon dioxide at 400 psig and expanded by treatment in a tower swept with 475° F. steam/air mixture by the method of U.S. application Ser. No. 822,793 as follows: The cut filler at approximately 19% OV was impregnated with liquid $CO_2$ at 400 psig and approximately 19° F. for one-half minute. The liquid was drained, and after a second drain the pressure was released. The filler containing solidified $CO_2$ was fed at about 3 lb/min into a vertical drying tower eight inches in diameter with an upward flow of steam/air (85/15) at 475° F. and 125 ft/min. A cyclone separator isolated the expanded product. One-pound samples were used in the post treatment step. The samples had an OV of 2.0% and reordered CV of 75 cc/10 g. Samples from the tower and without reordering were treated by exposure in an oven modified to take an upflow or downflow gas supply. The product was spread in a tray made from 14-mesh screen including a cover. Thermocouples above and below the tray measured the gas temperature. Air at 250° F. was passed through the bed upward at a different velocity for each sample from 1.2 to 7.8 feet/second for 5 minutes. The products had less than 1% OV; and on reordering to equilibrium at 60% RH/75° F., they had CV values of 88 to 99 cc/10 g. Similar treatment of samples similarly expanded, with air at 350° F. for 1 minute, gave products likewise having less than 1% OV and reordered CV's of 113 to 128 cc/10 g. The optimum air velocity for maximum expansion was 7.8 feet/-second at 250° F. and 3.1 feet/second at 350° F. in this unit. Treatment of product with air at 200° F. and 3 feet/second for 18 hours gave an increase of CV from 71 to 87.

EXAMPLE 2

Four 1-pound samples of tobacco filler were expanded by the ammonia/carbon dioxide method set forth in Example 11 of Armstrong et al, U.S. Pat. No. 3,771,533, except that $CO_2$ gas was used to discharge the residual vacuum. One-pound samples, taken without moisture equilibration for the post treatment step, had initial corrected CV's of 65 to 74 cc/10 g. Treatment as in Example 1 with air at 275° F. for 10 minutes (about 3 feet/second flow rate) gave final corrected CV's that were in the same order for the four samples as the initial values and varied from 77 to 85 cc/10 g.

EXAMPLE 3

Samples weighing 1 pound each of commercial blend cigarette filler had been expanded by the liquid carbon dioxide impregnation process under conditions described in Example 1. The properties are shown under Control in Table I below. These samples from the tower and without reordering were treated in the equipment described in Example 1 with superheated steam for varying exposure times at four temperatures. Table I lists the conditions and the CV values observed.

TABLE 1

STATIC BED STEAM POST TREATMENT[1,2]
Time/Temperature Effect

| Control | | | |
|---|---|---|---|
| As-Is OV, % | 1.9 | | |
| Reordered OV, % | 11.68 | | |
| Reordered CV, cc/10 g | 78.8 | | |
| CCV at 11%[3] | 83.8 | | |
| Steam Treatment, 250° F. | 3 min. | 5 min. | 10 min. |
| As-Is OV, % | 0.8 | 0.4 | 0.0 |
| Reordered OV, % | 11.09 | 10.44 | 10.06 |
| Reordered CV, cc/10 g | 88.1 | 101.8 | 109.2 |
| CCV at 11%[4] | 88.8 | 99.2 | 101.5 |
| Steam Treatment, 300° F. | 1 min. | 2 min. | 5 min. |
| As-Is OV, % | 0.6 | 0.6 | 0.4 |
| Reordered OV, % | 10.70 | 10.03 | 7.42 |
| Reordered CV, cc/10 g | 93.4 | 114.8 | 135.9 |
| CCV at 11%[4] | 90.9 | 106.8 | 106.5 |
| Steam Treatment, 350° F. | 0.5 min. | 1 min. | 1.5 min. |
| As-Is OV, % | 1.8 | 1.6 | 1.6 |
| Reordered OV, % | 9.72 | 9.25 | 8.95 |
| Reordered CV, cc/10 g | 118.6 | 138.3 | 143.2 |
| CCV at 11%[4] | 108.1 | 124.0 | 126.4 |
| Steam Treatment, 400° F. | 0.25 min. | 0.5 min. | 1 min. |
| As-Is OV, % | 0.4 | 0.9 | 0.6 |
| Reordered OV, % | 10.01 | 8.37 | 8.12 |
| Reordered CV, cc/10 g | 90.2 | 149.5 | 159.5 |
| CCV at 11%[4] | 82.1 | 127.9 | 135.9 |

[1]1-pound per batch
[2]3.1 feet/second flow through bed
[3]correction factor of 7.4 CV/% OV
[4]correction factor of 8.2 CV/% OV

EXAMPLE 4

Post treatment of DIET material was carried out in apparatus having a static bed modified to accept an upflow or downflow gas supply. In the apparatus, steam or air can be brought to a desired temperature and velocity in a heating tower and then be passed through the static bed.

In a series of runs, each expanded tobacco sample to be treated was placed in a tray which had 14 mesh screen above and below the tobacco. The unit is capable of holding two trays but generally only one tray was used. Typically, a 1.0 or 1.5 pound sample was placed in the tray for treatment.

Temperature measurements were obtained by thermocouples located above and below the sample tray.

The liquid carbon dioxide expanded tobacco (DIET) used in this series of runs had been impregnated with liquid carbon dioxide at 400 psig and converted to dry ice upon release of the pressure and the dry ice-containing tobacco was then passed through an 8" tower in contact with 475° F. steam at a feed rate of 3⅛ lbs/min, to expand the tobacco. Several special tests, as indicated later, used material that had been expanded at somewhat different tower conditions.

The ammonia-carbon dioxide expanded tobacco (ET) used in the tests described later was obtained from standard production runs at a point prior to any reordering.

The DIET and ET samples employed in this example were from materials expanded as described in Examples 1 and 2, respectively.

As indicated, DIET material was subjected to heat treatment using both steam and air at temperatures from about 250° F. to about 400° F. at various treatment times.

It was found that the present post expansion heat treatment (PEHT) of DIET tower product was found to result in an additional increase in cylinder volume which is stable through reordering and storage.

It was found in this series of runs that, by fixing the treatment time and increasing the temperature, greater increases in product CV were obtained. This relationship held true for both steam and air up to approximately 400° F. at which point product quality began to deteriorate for treatments over one minute.

It was also found that the duration of treatment also affected the increase in product CV. Increasing the treatment time at various temperatures was found to increase the product CV. These results indicate that temperature and time can be manipulated to obtain similar CV results. For example, a 100 product CV can be obtained with 250° F. steam and approximately 6 minutes treatment while the same CV is reached with 300° F. steam at less than 2 minutes treatment.

A comparison of steam and air post treatment in these runs indicates that higher CV's can be obtained with steam at the same treatment conditions. Treatment at 300° F. for 2 minutes resulted in a 38 CV unit change for steam while air produced only a 16 unit change. Air treatment also increased the tobacco darkening reaction and allowed burning to occur sooner than steam due to the presence of oxygen. Sticking of the tobacco to the treatment trays occurred to a larger degree with steam, possibly due to condensation on the tobacco.

The results of these runs, for both steam and air, indicate that the CV versus time relationship is not linear using rectangular coordinates. The rate of CV increase appears to be rapid initially reaching an asymptotic maximum.

Tables II through IV, set forth later in this specification, present the reordered CV, OV and product exit OV for certain runs with the indicated PEHT following a DIET expansion process. It can be noted from these data that increases in CV are accompanied by decreases in the reordered OV level. The results showed an increase in filling power, when corrected to 11% moisture. The CCV results for steam appear to be better than those for air.

Post treatment of DIET product at tower exit moistures of 2, 5, 8 and 12% was studied in a series of runs. The data show that CV increases occur for all starting moistures. The DIET was treated with both 250° F. and 325° F. steam. CV increases were obtained for both treatments. The 325° F. steam treatment at one minute gave approximately 35 CV units increase for all moistures. The 250° F. steam for five minutes gave results ranging from 4 to 26 units CV increase with the lower CV increases associated with decreasing tower exit moisture.

The tests indicate that treating tower product dry (approximately 2%) and reordered (approximately 11%) appeared to give similar CV increases, as is set forth in Table V. The reordered OV's for these materials were similar for air post treatment while steam treatment resulted in slightly higher reordered OV's for the pre-reordered DIET.

Treatment with either steam or air increased the unreordered SV of the 11% OV DIET. Subsequent reordering lowers the SV but not to the nonpost-treated level. Whether the changes in SV are solely due to differences in OV or to cellular changes is unknown at this time.

The most significant finding of this test was that increases in CV can be obtained without severely overdrying the DIET material. As shown in Table V, the tests indicate an increase of 9 CV units for the 11% moisture starting material dried only to an 8.9% exit moisture by steam post treatment. This indicates that a "setting" of the tobacco structure occurs before all of the moisture has been removed. Even without overdrying, it can be noted that a reduction in reordered OV occurs. It is possible that either the bound moisture is removed during treatment or that steam distilling or chemical modification of the hydrophilic groups is occurring.

In a series of runs, DIET samples were post treated at various conditions and then moisture equilibrated at standard reordering conditions (75° F./60% RH, 25 ft/minute air flow) to determine the time required to reach equilibrium. The DIET was post treated with steam and air using both mild (250° F., 5 minutes) and severe (325° F., 2 minutes) treatment conditions. These samples were then subjected to reordering and the CV/OV was monitored with time.

The results indicate that for product from all four PEHT conditions equilibration occurs in less than 24 hours. It is estimated that at 16 hours the samples have reached 95+% equilibration. Samples submitted for routine CV/OV determinations are conditioned for at least 16 hours and should essentially have reached full equilibration in that time period.

We have found that post-expansion heat treatment of DIET results in a reduction of reordered OV, the degree of which depends on the severity of treatment. In order to compare the CV results at the reduced reordered OV levels, it was necessary to develop a CV/OV correction factor.

Post treatment of DIET which yields an increase in CV appears to lower the equilibrium OV. Increasing the severity of that steam gives a more severe treatment compared to air as indicated by the lower reordered OV values at comparable treatment conditions. A test was conducted to determine whether the recordered OV level could be increased by initially over-humidifying the PEHT samples.

DIET at 1.9% OV was post treated with 325° F. steam for 0.75 minutes. These samples were then reordered at 75° F./60% RH for approximately 24 hours. After this initial reordering, the material was conditioned at 90° F./85% RH for 0, 2 and 4 hours to obtain several increased moisture levels (9.5, 14.9 and 16.8% OV, respectively). These samples were then re-equilibrated at 75° F./60% RH for 48 hours to observe any changes in the final reordered OV levels.

The results for the above treatment are given in Table VIII and show no change in equilibrium moisture level. Similar results were found for samples post treated for 1.25 minutes at the same temperature (Table VI). Similar tests conducted with ET showed slight increases in reordered OV, but the differences were not large enough to conclude that changes in the equilibrium OV were actually occurring (Table IX).

Specific volume is a measure of the volume displacement of tobacco when immersed in acetone. Typically, filler has an SV of 1 cc/g which is probably somewhat lower than uncured tobacco. Drying causes a loss in SV due to collapse of cell spaces that can be recovered by either the DIET or $NH_3$-$CO_2$ impregnation/expansion process. The DIET process will yield SV values between 2.5 and 4.0 prior to reordering. Reordering causes a collapse in SV due to moisture uptake which enables the cell walls to become more pliable. Once the tobacco is expanded, the collapse can be minimized by post expansion heat treatment (PEHT). It is believed that the additional heat treating possibly relieves mechanical strains within and between the cells resulting from the expansion process. Heat treating reduces the strains so that the expanded cells do not collapse upon moisture addition.

Expanded tower product which exists at varying moistures will yield degrees of expansion as measured by CV and SV. Lower tower exit moistures from the expansion (or increased heat treatment during expansion) result in additional filling power. Both the dry (as-is moisture) and reordered product SV's increase with severity of tower treatment.

PEHT results in an additional increase in either CV or CCV for both DIET and ET. The additional heat treatment reduces the OV of the expanded product and causes a change in the tobacco structure which results in the increase in filling power.

Table VII sets forth the data pertaining to SV and CCV for the DIET and ET results reported above. The data for PEHT DIET which has been recordered prior to post treatment indicates little difference between the unreordered and re-reordered SV values. These values appear to be typical of the reordered data for treatment of dry tower product.

Weight loss of DIET was determined in the static bed as a function of temperature during air post treatment. Samples of DIET were weighed as accurately as possible before and after treatment to observe the mass of tobacco removed either as "fines" or stripped off in the gas phase.

Samples of DIET were treated for one minute at temperatures between 90° and 350° F. and were analyzed for dry weight basis (DWB) physical weight loss, OV losses, and changes in alkaloid and the reducing sugar content. Reducing sugar and alkaloid losses do not appear to be significant until temperatures above 250° F. are encountered, at which point they begin to increase rapidly. Reductions in the moisture level appear after 100° F. The DWB weight losses appear to be 1% or less under 250° F. and begin to increase significantly after this temperature to an observed maximum of 7% at 350° F. The results of non-volatile inorganic component tests indicate no increase in these levels so that possibly a portion of the loss at higher temperatures can be attributed to increased brittleness of the tobacco fibers and subsequently higher losses in fines.

The reordered products were made into commercial filler blends at a 25% level replacing ET and a portion of the bright strip. Control blends were also prepared with 25% standard DIET and with unexpanded bright. The experimental post-treated blends (Table VIII) did not show the expected 1 to 7 unit CV increase over the standard DIET blend. Additional tests have shown that substantial increases in blend CV are achieved with post-treated DIET.

The purpose of this study was to ensure that CV increases due to post treatment are still evident after blending and reordering. ET was post treated with 325° F. air for two minutes, then reordered and blended with commercial filler at various levels. These results were compared to similar blends using untreated ET.

The blends were made at 0, 10, 25, 50 and 100% control ET (not post treated) and post-treated ET. Blend CV results versus percent weight addition of ET for the control and post-treated material did show a substantial CV improvement for the post-treated material. Correcting the blend CV's to a common moisture level of 12.5% OV still gave better results for the post-treated ET showing that the additional CV increase is not simply due to a reduction in equilibration moisture (Table IX).

The theoretical CV/OV values for the blends were calculated using the data for the blend, control and post-treated ET. The theoretical values gave reasonable agreement to the actual CV/OV changes obtained, but the actual change in CV was slightly less than predicted. Some of this loss can probably be attributed to breakage during blending and differences in equilibrated OV. Also, the actual reordered OV values were higher than predicted which indicates that the ET might be gaining moisture due to changes in room conditions during the blend reordering. A similar observation was made comparing the post-treated material to the control ET (Table X). It appears that both the actual CV gain and OV reduction are slightly less than expected from the predicted values.

DIET was post treated and then blended with commercial filler (without ET) as a follow-up on blend CV increases using post-treated ET. The DIET was post treated with 275° F. air for 0, 5, 10, 15 and 20 minutes and then blended at 0, 25, 50, 75 and 100% with commercial filler.

As experienced in the previous blend study with ET, all of the post-treated DIET samples showed improvements in blend CV following reordering. The CV results were corrected to 12.5% OV by using the weight fractions multiplied by the correction factor of commercial filler (2.5 CV/% OV) and DIET (7.4 CV/% OV for the control and 8.2 CV/% OV for post-treated samples) at each blend level. The results as shown in Table XI indicate that improvements in blend CCV correspond to the post-treated DIET CCV increases. The improvements in blend CCV for the post-treated material over the control show that the increase is not solely due to reductions in equilibration moisture. Comparison of the expected CCV results based on the commercial filler and DIET to the actual results obtained show good agreement which indicates that the gain in CV by post treatment is not lost after blending.

Tables II through XI are set forth hereinafter.

Certain abbreviations have been used throughout this specification, for purposes of simplicity, and these terms are defined below:

ET=Tobacco which has been expanded in accordance with a process employing ammonia gas and carbon dioxide gas, as described earlier in this specification.

DIET=Tobacco which has been expanded by a process employing impregnation of the tobacco with liquid carbon dioxide, conversion of the liquid carbon dioxide to solid carbon dioxide and vaporization of the solid carbon dioxide by heating or the like, as described earlier in this specification.

Unless otherwise specified, all pressures are presented in terms of pounds per square inch gauge and all temperatures are presented in degrees Fahrenheit.

TABLE II

STATIC BED DIET AIR POST TREATMENT[1,2]
Time/Temperature Effect

| Control | | | |
|---|---|---|---|
| As-Is OV, % | 1.9 | | |
| Reordered OV, % | 11.71 | | |
| Reordered CV, cc/10 g | 70.9 | | |
| CCV at 11%[3] | 76.1 | | |
| Air Treatment, 250° F. | 2 min. | 5 min. | 10 min. |
| As-Is OV, % | 0.4 | 0.2 | 0.0 |
| Reordered OV, % | 12.56 | 12.26 | 11.78 |
| Reordered CV, cc/10 g | 69.8 | 75.7 | 84.3 |
| CCV at 11%[4] | 82.6 | 86.0 | 90.7 |
| Air Treatment, 300° F. | 1 min. | 2 min. | 3 min. |
| As-Is OV, % | 0.4 | 0.2 | 0.2 |
| Reordered OV, % | 11.69 | 11.71 | 11.27 |
| Reordered CV, cc/10 g | 82.6 | 86.8 | 94.6 |
| CCV at 11%[4] | 88.2 | 92.6 | 96.8 |
| Air Treatment, 350° F. | 0.5 min. | 0.75 min. | 1 min. |
| As-Is OV, % | 0.2 | 0.4 | 0.0 |
| Reordered OV, % | 11.05 | 10.61 | 10.33 |
| Reordered CV, cc/10 g | 100.5 | 106.4 | 114.5 |
| CCV at 11%[4] | 100.4 | 103.2 | 109.0 |
| Air Treatment, 400° F. | 0.25 min. | 0.5 min. | 1 min. |
| As-Is OV, % | 0.5 | 0.0 | 0.0 |
| Reordered OV, % | 9.99 | 8.36 | 8.61 |
| Reordered CV, cc/10 g | 101.5 | 120.5 | 121.3[5] |
| CCV at 11%[4] | 93.2 | 98.8 | 101.7 |

[1]one-pound DIET/batch
[2]3.1 ft/sec. flow through bed
[3]correction factor of 7.4 CV/% OV
[4]correction factor of 8.2 CV/% OV
[5]this sample was beginning to burn

TABLE III

STATIC BED DIET STEAM PEHT - TIME EFFECT
(275° F. Steam PEHT, 3.1 fps Gas Velocity)

| Treatment Time Min. | OV % | Reordered CV/OV cc/10 g/% | CCV at 11% |
|---|---|---|---|
| Control | 2.2 | 73.5/12.2 | 82.2[1] |
| 0.5 | 2.9 | 76.9/11.9 | 84.1[2] |
| 1.0 | 2.8 | 78.1/11.7 | 84.1[2] |
| 1.5 | 1.8 | 93.0/11.1 | 93.6[2] |
| 2.0 | 1.5 | 94.6/10.8 | 93.0[2] |
| 3.0 | 1.3 | 102.5/10.4 | 97.2[2] |
| 4.0 | 1.3 | 105.5/10.4 | 100.6[2] |
| 5.0 | 1.1 | 104.3/10.3 | 98.6[2] |
| 7.0 | 1.3 | 115.0/9.9 | 107.6[2] |
| 10.0 | 1.2 | 130.6/9.4 | 117.3[2] |
| 15.0 | 1.1 | 134.9/9.3 | 120.9[2] |
| 20.0 | 1.2 | 136.5/9.2 | 121.6[2] |
| 25.0 | 1.1 | 132.6/9.2 | 117.4[2] |
| 30.0 | 1.2 | 139.2/8.8 | 121.2[2] |

[1]correction factor of 7.4 CV/% OV
[2]correction factor of 8.2 CV/% OV

TABLE IV

STATIC BED DIET AIR PEHT - TIME EFFECT
(275° F. Air PEHT, 3.1 fps Gas Velocity)

| Treatment Time Min. | OV % | Reordered CV/OV cc/10 g/% | CCV at 11%[2] |
|---|---|---|---|
| Control | 2.1 | 75.5/12.2 | 84.1[1] |
| 0.5 | 0.6 | 84.3/11.5 | 88.6 |
| 1.0 | 0.6 | 77.5/11.7 | 83.6 |
| 1.5 | 0.6 | 84.1/11.4 | 87.0 |
| 2.0 | 0.7 | 84.9/11.2 | 87.0 |
| 3.0 | 0.5 | 92.4/11.0 | 92.6 |
| 4.0 | 0.6 | 90.8/11.1 | 91.8 |
| 5.0 | 0.3 | 92.7/11.0 | 92.4 |
| 7.0 | 0.2 | 98.9/10.8 | 97.1 |
| 10.0 | 0.0 | 102.7/10.7 | 100.1 |
| 15.0 | 0.0 | 109.7/10.3 | 104.1 |

TABLE IV-continued

STATIC BED DIET AIR PEHT - TIME EFFECT
(275° F. Air PEHT, 3.1 fps Gas Velocity)

| Treatment Time Min. | OV % | Reordered CV/OV cc/10 g/% | CCV at 11%[2] |
|---|---|---|---|
| 20.0 | 0.0 | 115.0/10.1 | 107.7 |
| 25.0 | 0.0 | 129.0/9.9 | 120.3 |

[1]correction factor of 7.4 cc/% OV
[2]correction factor of 8.2 cc/% OV

TABLE VII-continued

PHYSICAL DATA FOR POST-EXPANSION HEAT-TREATED MATERIAL

| | As-Is OV | CV/OV | CCV | SV As-Is | SV Reo. | PEHT |
|---|---|---|---|---|---|---|
| 11% OV DIET | 11.1 | 79.1/10.6 | 76 | 2.4 | 2.5 | Control |
| | <1.0 | 95.7/9.5 | 83 | 2.7 | 2.6 | 325° F. Air |
| | <1.0 | 101.3/9.1 | 86 | 2.4 | 2.5 | |
| | <1.0 | 108.3/8.9 | 91 | 2.7 | 2.7 | |
| | 8.9 | 88.4/9.8 | 78 | 2.6 | 2.4 | 325° F. Steam |
| | 1.9 | 95.7/9.6 | 84 | 3.0 | 3.0 | |
| | 3.6 | 113.1/9.3 | 99 | 3.2 | 2.8 | |
| 2% OV DIET | 2.4 | 75.4/10.8 | 74 | 3.7 | 3.1 | Control |
| | 0.8 | 85.3/10.2 | 79 | 3.4 | 3.1 | 220° F. Air |
| | 0.6 | 88.6/10.0 | 81 | 3.5 | 3.3 | |
| | 0.4 | 92.6/10.0 | 84 | 3.6 | 3.3 | |
| | 0.7 | 88.6/10.4 | 84 | 3.2 | 3.3 | 230° F. Air |
| | 0.6 | 98.1/9.9 | 89 | 3.6 | 3.6 | |
| | 0.2 | 101.6/9.9 | 92 | 3.6 | 3.6 | |
| | 0.5 | 92.3/10.6 | 89 | 3.5 | 3.5 | 240° F. Air |
| | 0.4 | 103.2/10.0 | 95 | 3.5 | 3.4 | |
| | 0.2 | 105.7/9.9 | 97 | 3.6 | 3.7 | |
| 4% OV ET | 4.4 | 52.0/12.7 | 63 | 3.1 | 2.4 | Control |
| | 1.4 | 62.6/11.6 | 67 | 3.0 | 2.5 | 220° F. Air |

TABLE V

PEHT OF DRY AND REORDERED DIET

| 325° F. PEHT Treatment | Dry Material | | | | | | | Reordered Material | | | | | | |
|---|---|---|---|---|---|---|---|---|---|---|---|---|---|---|
| Gas | Air | | | | Steam | | | Air | | | | Steam | | |
| Treatment Time (min) | Control | 0.5 | 1.0 | 1.25 | 0.5 | 1.0 | 1.25 | Control | 0.5 | 1.0 | 1.25 | 0.5 | 1.0 | 1.25 |
| OV, % | 1.7 | <1.0 | <1.0 | <1.0 | 6.8 | 2.9 | <1.0 | 11.1 | <1.0 | <1.0 | <1.0 | 8.9 | 1.9 | 3.6 |
| SV - At Moisture, cc/g | 3.4 | 3.2 | 3.6 | 3.6 | 3.1 | 3.2 | 3.5 | 2.1 | 2.7 | 2.4 | 2.7 | 2.4 | 3.0 | 3.1 |
| SV - Reordered, cc/g | 2.2 | 2.4 | 2.8 | 2.8 | 2.2 | 2.6 | 2.6 | 2.2 | 2.4 | 2.3 | 2.5 | 2.2 | 2.7 | 2.5 |
| Reordered CV, cc/10 g | 84.7 | 94.3 | 111.9 | 111.1 | 91.5 | 113.4 | 114.1 | 79.1 | 95.7 | 101.3 | 108.3 | 88.4 | 95.7 | 113.1 |
| Reordered OV, % | 10.2 | 9.5 | 9.1 | 9.0 | 9.4 | 8.8 | 8.9 | 10.6 | 9.5 | 9.1 | 8.9 | 9.8 | 9.6 | 9.3 |
| CCV** at 11% | 79* | 82 | 96 | 94 | 78 | 96 | 97 | 76* | 83 | 86 | 91 | 78 | 84 | 99 |
| Calcium, % DWB | 2.0 | — | — | 2.1 | — | — | 2.0 | 2.2 | — | — | 1.9 | — | — | 1.9 |
| Potassium, % DWB | 3.1 | — | — | 2.9 | — | — | 3.0 | 3.0 | — | — | 3.2 | — | — | 3.2 |
| Magnesium, % DWB | 0.4 | — | — | 0.4 | — | — | 0.4 | 0.4 | — | — | 0.4 | — | — | 0.4 |
| Shred Thickness, m | 219 | — | — | 249 | — | — | 263 | 239 | — | — | 247 | — | — | 232 |

*Corrector factor - 7.4 CV/% OV
**Correction factor - 8.2 CV/% OV

TABLE VI

PEHT OF DIET, HYSTERESIS TEST

| | DIET Control | PEHT DIET 325° F. Steam | Treatment of Reordered PEHT Material At 90° F./85% RH | | | Reordering of 90° F./85% RH Material for 48 Hrs. Sample | | |
|---|---|---|---|---|---|---|---|---|
| Treatment Time | — | 0.75 Min. | 0 Hr. | 2 Hrs. | 4 Hrs. | 0 Hr. | 2 Hrs. | 4 Hrs. |
| OV, % | 1.9 | 2.4 | 9.5 | 14.9 | 18.6 | — | — | — |
| Reordered CV/OV | 82.6/11.2 | 116.6/9.5 | — | — | — | 93.3/10.6 | 96.0/10.7 | 96.6/10.6 |
| CCV | 84* | 104** | — | — | — | 90** | 94** | 93** |
| Treatment Time | — | 1.25 Min. | 0 Hr. | 2 Hrs. | 4 Hrs. | 0 Hr. | 2 Hrs. | 4 Hrs. |
| OV, % | 1.9 | 1.0 | 9.1 | 13.4 | 17.6 | — | — | — |
| Reordered CV/OV | 82.6/11.2 | 125.0/9.1 | — | — | — | 112.6/10.0 | 108.8/10.2 | 110.2/10.2 |
| CCV | 84* | 109** | — | — | — | 104** | 102** | 104** |

*Correction factor - 7.4 CV/% OV
**Correction factor - 8.2 CV/% OV

TABLE VII

PHYSICAL DATA FOR POST-EXPANSION HEAT-TREATED MATERIAL

| | As-Is OV | CV/OV | CCV | SV As-Is | SV Reo. | PEHT |
|---|---|---|---|---|---|---|
| 2% OV DIET | 1.7 | 84.7/10.2 | 79 | 3.4 | 2.4 | Control |
| | <1.0 | 94.3/9.5 | 82 | 3.2 | 2.6 | 325° F. Air |
| | <1.0 | 111.9/9.1 | 96 | 3.6 | 3.1 | |
| | <1.0 | 111.1/9.0 | 94 | 3.6 | 3.1 | |
| | 6.8 | 91.5/9.4 | 78 | 3.3 | 2.4 | 325° F. Steam |
| | 2.9 | 113.4/8.8 | 96 | 3.3 | 2.8 | |
| | <1.0 | 114.1/8.9 | 97 | 3.5 | 2.8 | |

TABLE VII-continued

PHYSICAL DATA FOR POST-EXPANSION HEAT-TREATED MATERIAL

| | As-Is OV | CV/OV | CCV | SV As-Is | SV Reo. | PEHT |
|---|---|---|---|---|---|---|
| | 1.3 | 65.5/11.5 | 70 | 3.1 | 2.7 | |
| | 0.5 | 71.3/11.0 | 71 | 3.1 | 2.8 | |
| | 0.4 | 74.4/11.0 | 75 | 3.1 | 2.8 | 230° F. Air |
| | 0.4 | 77.3/10.9 | 77 | 3.1 | 2.9 | |
| | 0.2 | 80.7/10.8 | 79 | 3.2 | 2.9 | |
| | 0.9 | 78.3/10.9 | 77 | 3.2 | 2.9 | 240° F. Air |
| | 0.8 | 85.4/10.5 | 81 | 3.1 | 3.0 | |
| 2% OV | 2.4 | 77.6/11.9 | 84 | 3.8 | 3.2 | Control |
| DIET | 11.1 | 79.7/11.7 | 85 | 4.0 | 3.6 | 300° F. Steam |
| | 1.6 | 95.8/11.0 | 96 | 4.0 | 3.5 | |
| | 5.4 | 92.8/10.9 | 92 | 3.8 | 3.5 | |
| | 1.3 | 107.9/10.4 | 103 | 3.7 | 3.8 | |
| | 0.8 | 108.0/10.1 | 101 | 4.0 | 3.4 | |
| 11% OV | 11.1 | 85.0/11.6 | 89 | 3.4 | 3.4 | Control |
| DIET | 11.6 | 77.9/11.5 | 82 | 2.9 | 3.2 | 300° F. Steam |
| | 23.4 | 84.6/11.3 | 87 | 3.6 | 3.0 | |
| | 2.5 | 90.3/10.7 | 89 | 3.8 | 3.4 | |
| | 1.5 | 91.2/10.7 | 89 | 3.6 | 3.2 | |
| | 3.2 | 109.8/10.2 | 103 | 4.1 | 3.6 | |

TABLE VIII

CYLINDER VOLUME FOR 100% PEHT PRODUCT AND 25% BLEND ADDITION

| Material | 100% DIET/ET CV/OV | 100% DIET/ET CCV | 25% Blend CV/OV | 25% Blend CCV |
|---|---|---|---|---|
| DIET Control | 84.1/11.44 | 87.6[1] | 47.4/13.01 | 49.6[2] |
| 250° F. Air | 88.1/11.22 | 89.9[1] | 46.3/12.68 | 47.1[2] |
| 250° F. Steam | 105.1/9.98 | 96.9[1] | 45.2/12.77 | 46.3[2] |
| 325° F. Air | 111.4/9.80 | 101.8[1] | 47.2/12.88 | 48.8[2] |
| 325° F. Steam | 111.1/10.32 | 105.7[1] | 46.8/12.86 | 48.3[2] |
| ET Control | 69.8/12.09 | 78.5[1] | 42.7/13.26 | 45.9 |
| 250° F. Air | 84.9/11.15 | 86.1[1] | 43.4/13.12 | 46.0 |
| 260° F. Steam | 106.1/10.13 | 99.1[1] | 48.8/12.96 | 50.8 |
| 325° F. Air | 95.6/10.71 | 93.3[1] | 42.1/13.57 | 46.6 |
| 325° F. Steam | 99.3/10.27 | 93.5[1] | 46.8/13.11 | 49.4 |
| Bright Strip | — | — | 35.9/13.61 | 39.2[3] |

[1]8.0 CV/% OV
[2]4.25 CV/% OV
[3]3.0 CV/% OV

TABLE IX

BLEND DILUTION CV/OV DATA

| Blend Dilution % Expanded Tobacco | Control ET CV/OV | CCV[1] at 12.5% OV | Post-Treated ET CV/OV (cc/10 g) | Post-Treated ET CCV[2] at 12.5% OV |
|---|---|---|---|---|
| 0 | 35.6/13.5 | 38.6 | 35.6/13.5 | 38.6 |
| 10 | 37.3/13.4 | 40.4 | 40.6/13.2 | 43.0 |
| 25 | 41.2/13.1 | 43.7 | 47.9/12.8 | 49.2 |
| 50 | 49.8/12.5 | 49.8 | 60.6/11.9 | 57.2 |

TABLE IX-continued

BLEND DILUTION CV/OV DATA

| Blend Dilution % Expanded Tobacco | Control ET CV/OV | CCV[1] at 12.5% OV | Post-Treated ET CV/OV (cc/10 g) | Post-Treated ET CCV[2] at 12.5% OV |
|---|---|---|---|---|
| 100 | 72.6/11.4 | 64.2 | 108.7/9.1 | 80.8 |

[1]Correction factor determined by: C. Factor = (% commercial blend) (3.0) + (% ET) (7.6)
[2]Correction factor determined by: C. Factor = (% commercial blend) (3.0) + (% ET) (8.2)

TABLE X

THEORETICAL BLEND CV/OV VALUES (A) ET Control Compared to Commercial Blend CV Increase - OV Decrease

| % Blend Addition | Theoretical CV/OV Change cc/10 g/% OV | Actual CV/OV Change cc/10 g/% OV |
|---|---|---|
| 0 | — | — |
| 10 | +3.7/−0.2 | +1.7/−0.1 |
| 25 | +9.2/−0.5 | +5.6/−0.4 |
| 50 | +18.5/−1.0 | +14.2/−1.0 |
| 100 | — | — |

(B) ET Post Treated Compared to ET Control

| % Blend Addition | Theoretical CV/OV Change | Actual CV/OV Change |
|---|---|---|
| 0 | — | — |
| 10 | +3.6/−0.2 | +3.3/−0.2 |
| 25 | +9.0/−0.6 | +6.7/−0.3 |
| 50 | +18.0/−1.1 | +10.8/−0.6 |
| 100 | — | — |

TABLE XI

DIET BLEND CV AS FUNCTION OF POST-TREATMENT TIME

Air at 275° F.

| % DIET | CV After PEHT Time, Min. 0 | 5 | 10 | 15 | 20 | CCV* After PEHT Time, Min. 0 | 5 | 10 | 15 | 20 |
|---|---|---|---|---|---|---|---|---|---|---|
| 0 | 34.5 | — | — | — | — | 38.0 | — | — | — | — |
| 25 | 42.7 | 43.7 | 45.5 | 43.0 | 46.7 | 43.7 | 45.7 | 49.5 | 48.2 | 48.0 |
| 50 | 53.0 | 53.7 | 57.5 | 59.0 | 60.0 | 53.5 | 55.5 | 56.0 | 58.0 | 61.0 |
| 75 | 63.5 | 66.0 | 74.5 | 76.0 | 75.2 | 60.7 | 64.5 | 68.2 | 70.0 | 73.0 |
| 100 | 78.7 | 82.5 | 93.0 | 93.5 | 90.5 | 68.7 | 74.2 | 77.7 | 78.7 | 81.2 |

*Corrected to 12.5% OV.

What is claimed is:

1. In a process for expanding tobacco by a method which includes the steps of contacting tobacco with an expansion agent and then heating the tobacco to produce expanded tobacco having an OV value of less than about 6%, the improvement which comprises subjecting the expanded tobacco, having said OV value, to further heating under temperature conditions lower than the maximum temperature used for expanding the tobacco so that the heated, expanded tobacco has an OV value of less than 2%.

2. In a process comprising subjecting tobacco which has been expanded by a known expansion method including the steps of impregnating tobacco with an expansion agent and heating the impregnated tobacco to produce expanded tobacco having an OV value of less than about 6%, the improvement which comprises heating the expanded tobacco, having said OV value, for a period of at least 0.5 minute by contacting the expanded tobacco with a gaseous medium at a temperature within the range of from about 200° F. to about 450° F., but lower than the maximum temperature used for expanding the tobacco so that the heated, expanded tobacco has an OV value of less than 2%.

3. In a process comprising subjecting tobacco which has been expanded by a known expansion method which includes the steps of impregnating tobacco with liquid carbon dioxide, heating the impregnated tobacco to produce an expanded tobacco having an OV value of less than about 6% the improvement which comprises heating the expanded tobacco, having said OV value, prior to any reordering thereof, for a period of at least 0.5 minute by contacting the expanded tobacco with a gaseous medium at a temperature within the range of from about 200° F. to about 450° F., but lower than the maximum temperature used for expanding the tobacco, so that the heated, expanded tobacco has an OV value of less than 2%, and thereafter reordering the heated product.

4. The process of claim 1, 2 or 3 wherein the moisture content of the heated expanded tobacco is less than 1%.

5. The process of claim 2 wherein the expansion method employed comprises the method of expanding tobacco which comprises the steps of (1) impregnating the tobacco with liquid carbon dioxide under conditions such that substantially all of the liquid carbon dioxide is maintained in liquid form to impregnate the tobacco with the liquid carbon dioxide, (2) subjecting the liquid carbon dioxide-impregnated tobacco to conditions such that the liquid carbon dioxide is converted to solid carbon dioxide and (3) thereafter heating the solid carbon dioxide-containing tobacco whereby the solid carbon dioxide is vaporized to cause expansion of the tobacco.

6. The process of claim 2 wherein the method of expanding tobacco comprises the steps of contacting tobacco in an impregnation zone with ammonia and with carbon dioxide to impregnate the tobacco with both ammonia and carbon dioxide and then heating the impregnated tobacco to a temperature above about 250° F. for a time sufficient to expand the tobacco.

7. The process of claim 5 wherein the tobacco in step (3) is passed through a tower in contact with a hot gas and is thereafter passed through a separator.

8. The process of claim 2 wherein the hot gas is air.

9. The process of claim 2 wherein the hot gas is steam.

10. The process of claim 2 wherein the hot gas is a mixture of steam and air.

11. The process of claim 1, wherein the expanded tobacco is heated for at least about 0.5 minute.

* * * * *